United States Patent [19]

Wilder

[11] 4,453,578

[45] Jun. 12, 1984

[54] AUTOMATIC SHUT-OFF DISPENSING NOZZLE RESPONSIVE TO LIQUID IN A TANK REACHING A PREDETERMINED LEVEL AND TO A SUPPLY PRESSURE

[75] Inventor: Paul R. Wilder, Hamilton, Ohio

[73] Assignee: Dover Corporation, New York, N.Y.

[21] Appl. No.: 457,260

[22] Filed: Jan. 12, 1983

[51] Int. Cl.[3] ..... B67D 5/04

[52] U.S. Cl. ..... 141/209

[58] Field of Search ..... 141/5, 67, 95, 96, 207, 141/208, 209, 225, 226, 389; 222/52

[56] References Cited

U.S. PATENT DOCUMENTS

| | | | |
|---|---|---|---|
| 3,005,476 | 10/1961 | Klaus | 141/225 |
| 3,077,212 | 2/1963 | Hearn | 141/209 |
| 3,166,108 | 1/1965 | Hearn | 141/225 |
| 3,603,359 | 9/1971 | Belue | 141/209 X |
| 3,653,415 | 4/1972 | Boudot et al. | 141/208 |
| 3,710,831 | 1/1973 | Riegel | 141/208 X |

*Primary Examiner*—Stephen Marcus
*Assistant Examiner*—Mark Thronson
*Attorney, Agent, or Firm*—Kinney and Schenk

[57] ABSTRACT

An automatic shut-off nozzle has a first diaphragm responsive to the liquid in the tank being filled reaching a predetermined level to automatically stop flow through the nozzle. Flow also is automatically stopped when a second diaphragm responds to inactivation of a pump supplying the liquid to the nozzle. When a venturi poppet valve is located downstream from a main poppet valve in the nozzle, the venturi poppet valve has a bleed passage extending therethrough to enable the pressure upstream thereof and acting on the second diaphragm to be reduced to zero the pump is inactivated.

17 Claims, 6 Drawing Figures

FIG-3A
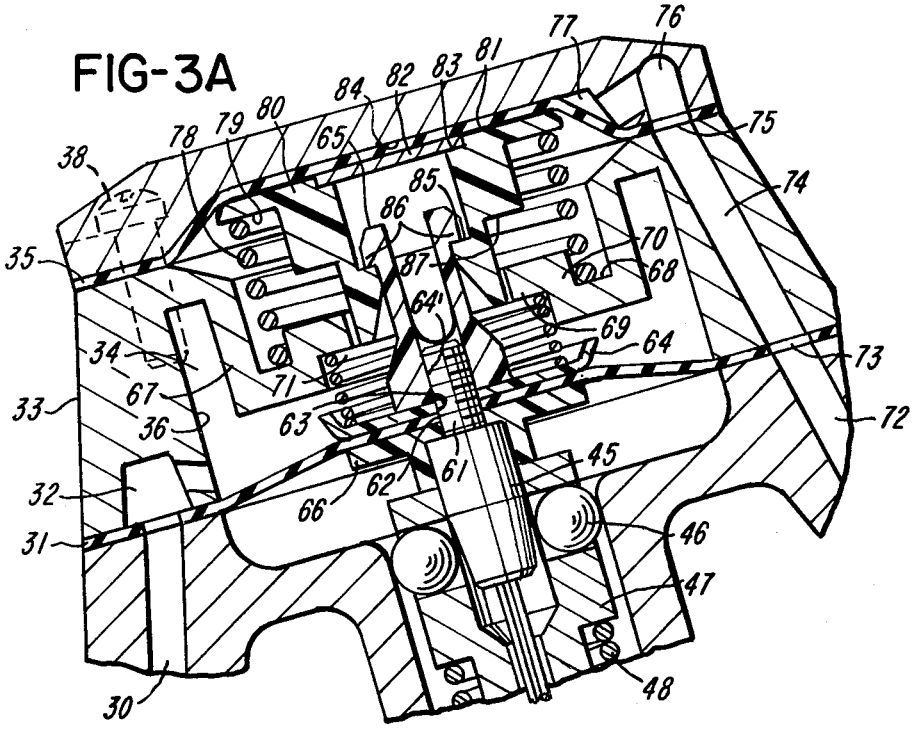
FIG-4
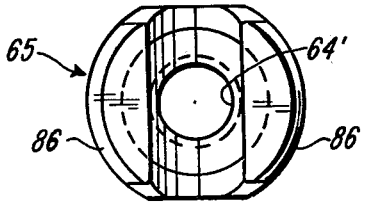
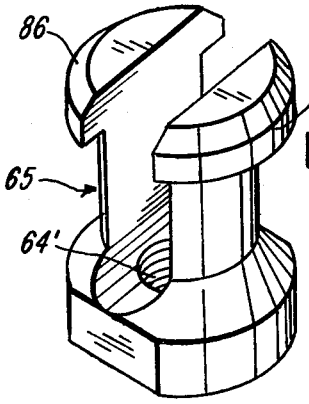
FIG-5

AUTOMATIC SHUT-OFF DISPENSING NOZZLE RESPONSIVE TO LIQUID IN A TANK REACHING A PREDETERMINED LEVEL AND TO A SUPPLY PRESSURE

This invention relates to an automatic shut-off nozzle and, more particularly, to an automatic shut-off nozzle having two diaphragms with one diaphragm responsive to liquid in the tank reaching a predetermined level and the other diaphragm being responsive to the supply pressure decreasing below a predetermined pressure.

At a self-service gasoline station at which a customer fills a vehicle tank with gasoline through a nozzle by actuating a handle to open a main valve in the nozzle, it is desired to have handle holding means to hold the handle in a valve open position such as the trigger of U.S. Pat. No. 3,653,415 to Boudot et al patent, for example. This allows the user to perform other tasks such as checking the oil level, for example, while the vehicle tank is being filled.

Two suggested arrangements for an automatic shut-off nozzle for use in a self-service station in which the valve opening handle may be retained in a valve open position are disclosed in U.S. Pat. No. 4,331,187 to Trygg and U.S. Pat. No. 4,343,336 to Trygg. Each of the aforesaid Trygg patents uses a complex and relatively expensive mechanism with a substantial portion of the mechanism disposed in the flow path of the gasoline through the nozzle. Each of the aforesaid Trygg patents also states that diaphragms cannot be satisfactorily employed.

However, the automatic shut-off nozzle of the present invention is able to satisfactorily use two diaphragms, rather than the complex and relatively expensive mechanism of each of the aforesaid Trygg patents, to automatically release the handle retaining means so that the main poppet valve is closed when flow from the pump to the nozzle is stopped by inactivation of the pump. Thus, the present invention enables an automatic shut-off nozzle to be used in a self-service station in which the valve opening handle is held in a valve open position by handle retaining or holding means such as a trigger in the manner shown and described in the aforesaid Boudot et al patent, for example.

The nozzle of the present invention accomplishes this through utilizing two diaphragms responsive to two different conditions. One of the diaphragms is responsive to a partial vacuum created in a chamber, which has the diaphragm form a wall thereof, when the liquid in the vehicle tank being filled reaches a predetermined level to cause the handle retaining or holding means to be moved to a non-latched position. The other of the diaphragms is responsive to the supply pressure in the passage means of the nozzle body decreasing below a predetermined pressure to cause the handle retaining means to be moved to a non-latched position when the flow from the pump is stopped.

While U.S. Pat. No. 3,166,108 to Hearn discloses two diaphragms with one diaphragm being responsive to a partial vacuum produced in a chamber by the vehicle tank being filled to a predetermined level and a second diaphragm being responsive to a pressure in the passage in the nozzle upstream of the main poppet valve and each diaphragm causing the handle retaining means to be moved to a non-latched position, the aforesaid Hearn patent utilizes a differential check valve upstream of the main poppet valve to substantially block flow through the nozzle passage from the pump to the main poppet valve when the pressure decreases to two to three psi, for example. The differential check valve of the aforesaid Hearn patent includes a resiliently biased disc having a bleed hole therein so that flow can still occur through the passage in the nozzle body of the aforesaid Hearn patent when it reduces to a very low flow rate as occurs with the last portion of the last gallon delivered by the pump. That is, the pumping system at the self-service station reduces the flow rate significantly when the last portion of the last gallon (one-fifth of a gallon or less) is to be delivered. This insures that cut off of the gasoline flow occurs when the precise amount for which the customer has paid has been delivered.

In the preferred embodiment of the nozzle of the present invention, venturi means, which produces the partial vacuum acting on the first diaphragm when the liquid in the vehicle tank being filled reaches a predetermined level, is located downstream of the main poppet valve in the same manner as in the aforesaid Boudot et al patent. Since the venturi poppet valve of the venturi means closes when the pressure decreases below the pressure produced by the pump operating at the minimum flow rate during delivery of the last portion of the last gallon, there would be trapping of pressure within the passage means in the nozzle body between the venturi poppet valve and the inlet of the nozzle body at the time that the pump shuts down. Since the pump is shut down, this trapped pressure could not escape through the pump. Accordingly, the nozzle of the present invention has bleed means, which are preferably in the venturi poppet valve, to relieve the pressure in the passage upstream of the venturi or secondary poppet valve so that the second diaphragm may be moved to its release position in which the main poppet valve is moved to its closed position to cause the handle retaining means to be rendered ineffective. By having the venturi means located downstream from the main poppet valve rather than adjacent thereto as in the aforesaid Hearn patent, the venturi means includes the differential check valve with the bleed means.

The automatic shut-off nozzle of the present invention also employs a structure for limiting the movement of the second diaphragm when it is subjected to the pressure of the supply pump. This is an improvement of the structure of the aforesaid Hearn patent wherein the motion of the second diaphragm is limited by structure directly engaging the second diaphragm so as to produce stresses thereon that are avoided in the nozzle of the present invention.

The automatic shut-off nozzle of the present invention also supports the entire surface of the second diaphragm when it is subjected to the pressure of the supply pump. This also is an improvement of the aforesaid Hearn patent.

An object of this invention is to provide an automatic shut-off nozzle having two condition responsive diaphragms in which its main poppet valve is automatically moved to its closed position upon shut off of the supply pump.

Another object of this invention is to provide an automatic shut-off nozzle for a self-service station in which its valve opening handle may be safely latched in a valve open position.

A further object of this invention is to provide an automatic shut-off nozzle having two condition responsive diaphragms in which the flow control valve is automatically closed when the pump is shut down or the liquid in the tank being filled reaches a predetermined level.

Still another object of this invention is to provide an automatic shut-off nozzle having a first diaphragm responsive to the liquid in the tank being filled reaching a predetermined level and a second diaphragm responsive to the pressurized source being inactivated with the second diaphragm having its movement by the pressurized source limited.

Other objects, uses, and advantages of this invention are apparent upon a reading of this description, which proceeds with reference to the drawings forming part thereof and wherein:

FIG. 3A is an enlarged sectional view of a portion of the nozzle of FIG. 1.

FIG. 4 is a top plan view of a diaphragm connecting pin.

FIG. 5 is a perspective view of the diaphragm connecting pin of FIG. 4.

Figure 1:
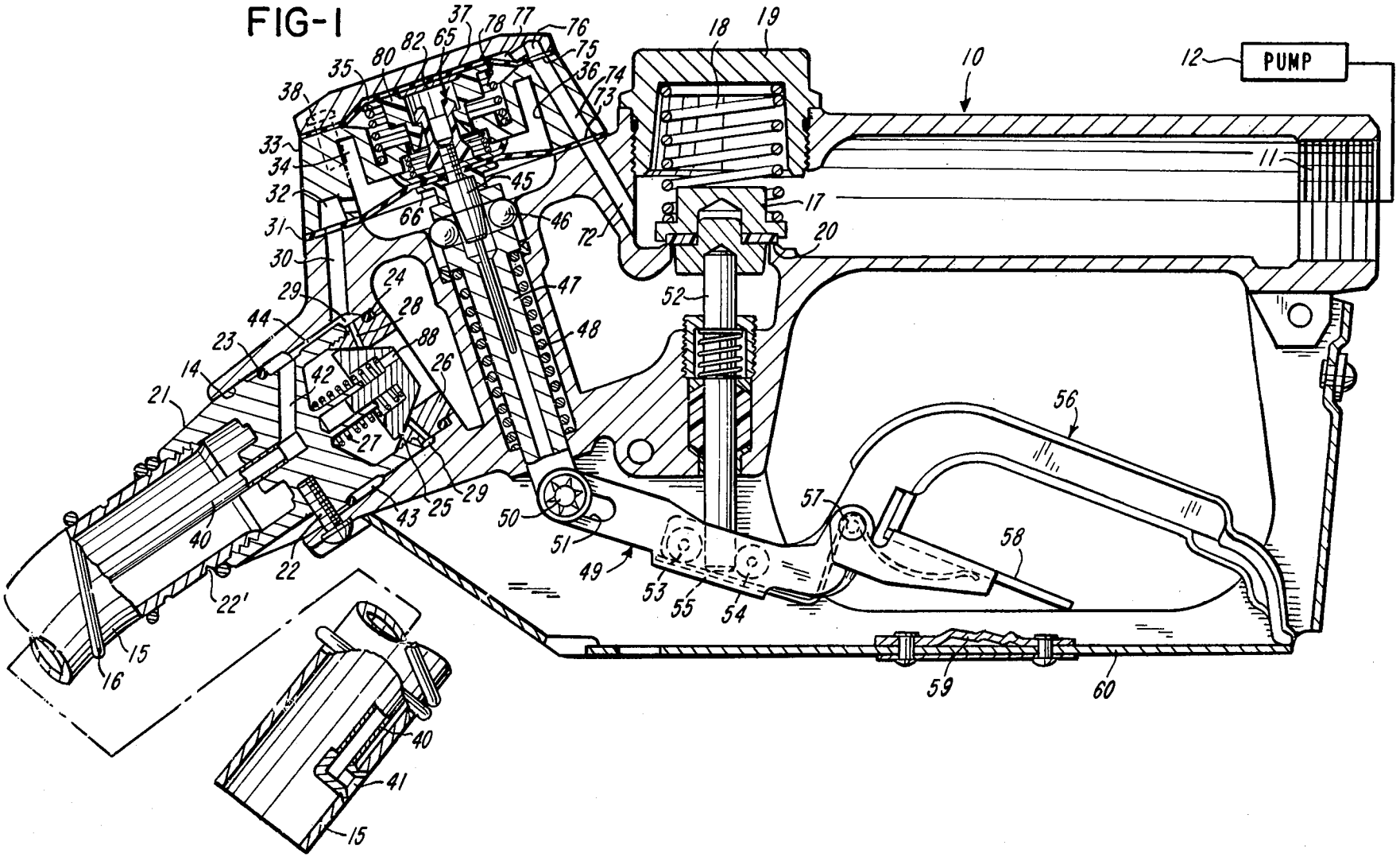
FIG. 1 is a sectional view, partly in elevation, of an automatic shut-off nozzle of the present invention and schematically showing a pump connected thereto with the main poppet valve closed, the pump inactivated, and the handle holding mechanism inactivated.

Referring to the drawings and particularly FIG. 1, there is shown a nozzle body 10 having an inlet 11 to which a pump 12 is connected by a hose. The pump 12 is controlled to supply liquid such as gasoline, for example, to the inlet 11 of the nozzle body 10 under a selected pressure. The pump 12 is controlled by suitable means such as a computer (not shown), for example, to cause the pump 12 to supply the liquid to produce a flow rate of about eight gallons per minute until the quantity remaining to be supplied is about one-fifth gallon or less than that for which there has been payment entered on the computer. At that time, the computer causes a reduction in the flow rate to about one-half gallon per minute to enable stopping of the supply of the liquid by the pump 12 when the exact amount of liquid to be delivered has been supplied to the inlet 11. The computer accomplishes this reduction in flow rate by causing closing of a valve in a main line from the pump 12 and opening of a valve in a by-pass line, which is substantially smaller than the main line, around the valve in the main line from the pump 12.

The nozzle body 10 has an outlet 14 to which a spout 15 is connected for dispensing the liquid flowing through the nozzle body 10 from the pump 12 to a container such as a vehicle fuel tank, for example. The spout 15 has a spring 16 thereon to contact the filler pipe of the container being filled.

A main poppet valve 17 is disposed in the nozzle body 10 between the inlet 11 and the outlet 14 to control the flow of the liquid through the body 10 from the inlet 11 to the outlet 14. A spring 18, which has one end acting against a cap 19 threaded into the nozzle body 10, has its other end acting against the poppet valve 17 to continuously urge the poppet valve 17 to its closed position against a valve seat 20.

A spout adapter 21 is connected to the outlet 14 of the body 10 by a screw 22. The spout adapter 21 has the upper end of the spout 15 threaded in its end. It should be understood that the spout 15 has a shear groove 22' therein so that it will break or shear to prevent any damage to the nozzle body 10 if the spout 15 should be retained in the vehicle tank when the vehicle is moved.

Sealing rings 23 and 24 are disposed between the spout adapter 21 and the body 10 so that liquid cannot flow therebetween. A venturi or secondary poppet valve 25 is slidably mounted on the spout adapter 21 and is continuously urged into engagement with a seating ring 26, which is threaded into the spout adapter 21 and has the sealing ring 24 cooperating therewith, by a spring 27. Thus, the pressure of the liquid flowing from the inlet 11 and past the main poppet valve 17 can overcome the spring 27 and move the secondary poppet valve 25 to an open position whenever the pump 12 is activated.

As the liquid flows between the poppet valve 25 and the seating ring 26 with the poppet valve 25 in an open position, a venturi effect is created in a plurality of passages 28 extending through the seating ring 26 and communicating with an annular chamber 29, which is formed between the spout adapter 21, the nozzle body 10, and the seating ring 26. The annular chamber 29 communicates through a passage 30 in the body 10, an opening in a diaphragm 31, and a passage 32 in a spacer 33 to a chamber 34. The chamber 34 is formed between the diaphragm 31 and a second diaphragm 35 with each of the diaphragms 31 and 35 forming a wall of the chamber 34.

The spacer 33 has a circular wall 36 defining the circumferential wall of the chamber 34. The second diaphragm 35 is retained in position on the upper end of the spacer 33 by a cap 37, which is secured to the nozzle body 10 through the spacer 33 by suitable means such as screws 38, for example.

The annular chamber 29 also communicates with a tube 40, which is connected with an opening 41 in the spout 15 adjacent the discharge end of the spout 15. The tube 40 communicates with the annular chamber 29 through a passage 42 in the spout adapter 21, an annular chamber 43 formed between the spout adapter 21 and the nozzle body 10, and a passage 44 between the spout adapter 21 and the nozzle body 10 extending from the annular chamber 43 to the annular chamber 29.

Accordingly, as long as the opening 41 is not closed due to the liquid within the tank reaching a predetermined level that indicates that the tank is filled, the venturi effect created by the flow of the liquid between the seating ring 26 and the poppet valve 25 draws air through the tube 40. However, as soon as the opening 41 is blocked, the chamber 34 has its pressure reduced due to the air therein being drawn therefrom because of the venturi effect in the passages 28 in the seating ring 26 whereby the diaphragm 31 moves upwardly because of the partial vacuum in the chamber 34. This venturi effect is more particularly described in U.S. Pat. No. 3,085,600 to Briede.

The diaphragm 31 is held between the nozzle body 10 and the spacer 33 to form a wall of the chamber 34. The diaphragm 31 has a latch pin 45 secured thereto for movement therewith. The latch pin 45 is disposed between three balls 46 (two shown), which are positioned within passages in a latch plunger 47. When the latch pin 45 is in the position shown in FIG. 2, the balls 46 prevent downward movement of the plunger 47, which is slidably mounted within the body 10.

Figure 3:
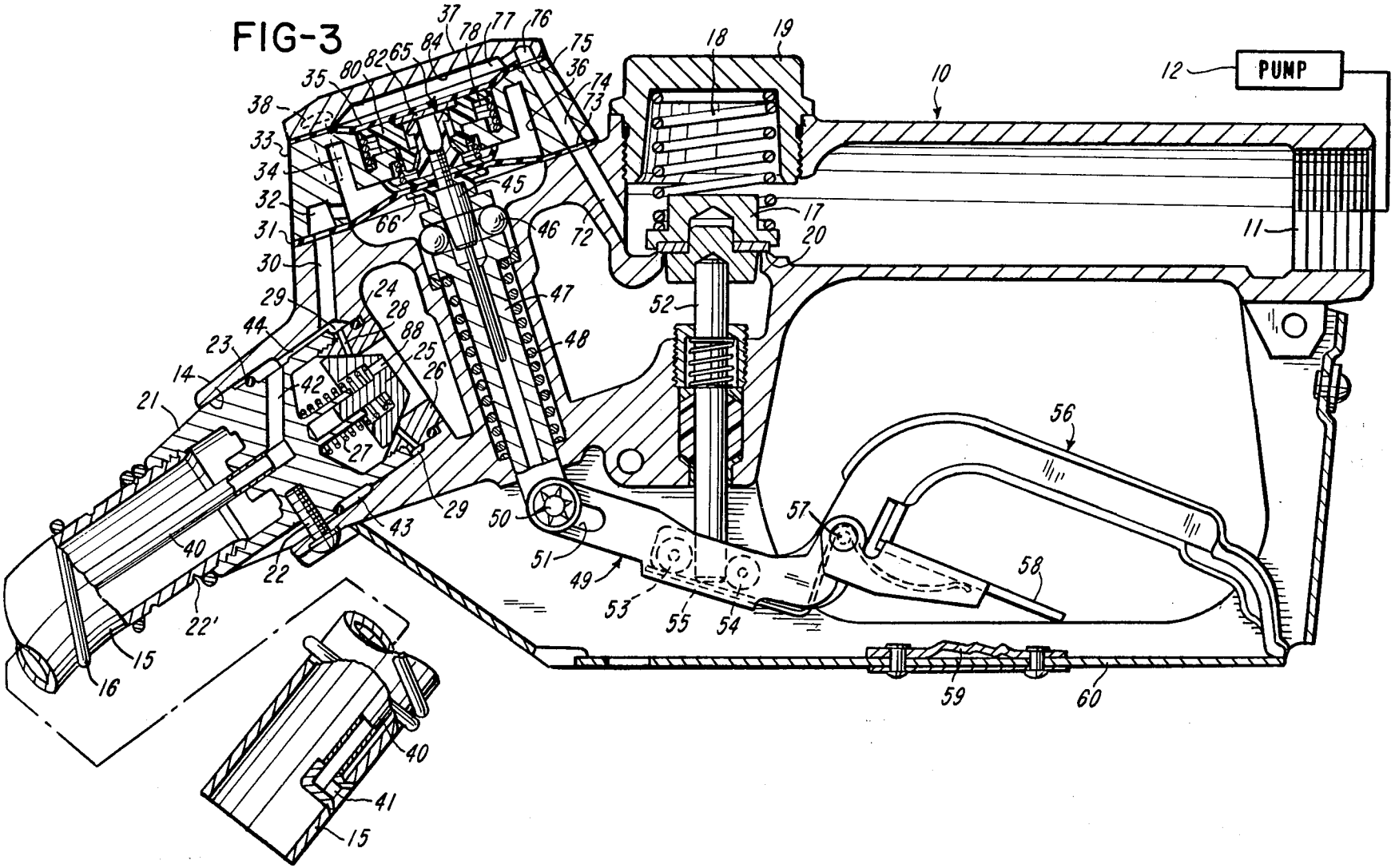
FIG. 3 is a sectional view, partly in elevation, of the nozzle of FIG. 1 with the pump activated, the main poppet valve closed, and the handle holding mechanism inactivated.

When the diaphragm 31 is moved upwardly due to the tank being filled to the predetermined level to block the opening 41 in the spout 15, the latch pin 45 is moved upwardly therewith to the position shown in FIGS. 1 and 3. The upward movement of the latch pin 45 disposes a tapered portion of the latch pin 45 between the balls 46 whereby the balls 46 may move inwardly to allow the latch plunger 47 to be moved downwardly against the force of a spring 48. The correlation between the tapered portion of the latch pin 45 and the latch plunger 47 is more specifically shown in U.S. Pat. No. 2,582,195 to Duerr.

The lower end of the latch plunger 47 is connected to a lower lever 49 by a pin 50. The pin 50, which is secured to the latch plunger 47, extends through slots (one shown at 51) in bifurcated portions of the lower lever 49 to provide a pin and slot connection between the latch plunger 47 and the lower lever 49 in the manner more particularly shown and described in the aforesaid Boudot et al patent. Thus, the lower lever 49 can both pivot and slide relative to the latch plunger 47.

The main poppet valve 17 has a stem 52 connected thereto with its lower portion extending exteriorly of the nozzle body 10 in the manner more particularly shown and described in the aforesaid Boudot et al patent. The lower end of the stem 51 extends between a pair of rollers 53 and 54, which are supported by the lower lever 49 in the manner more particularly shown and described in the aforesaid Boudot et al patent, and bears against a channel portion 55 of the lower lever 49 as more particularly shown and described in the aforesaid Boudot et al patent.

The lower lever 49 is pivotally connected to a handle or upper lever 56 by a rivet 57 with the handle 56 being formed in the manner more particularly shown and described in the aforesaid Boudot et al patent. The handle 56 may be held in any of three positions to provide different flow rates by a resiliently biased trigger 58, which is pivotally mounted on the rivet 57, engaging one of notches or steps in a rack 59, which is fixed to a guard 60, in the manner more particularly shown and described in the aforesaid Boudot et al patent.

The latch pin 45 is secured to an upper threaded portion 61 (see FIG. 3A) of the diaphragm 31. The upper threaded portion 61 extends through an opening 62 in the diaphragm 31 and an opening 63 in a washer 64 and into a threaded recess 64' in a connecting pin 65. The latch pin 45 also has a support 66 disposed between the latch pin 45 and the surface of the diaphragm 31 exposed to the atmosphere. The support 66 has a circumference of substantially the same diameter as the flat central portion of the washer 64 and its bottom annular surface engaging the upper surface of the latch plunger 47.

The spacer 33 has a downwardly depending annular portion 67 displaced inwardly from the wall 36 but integral therewith. The downwardly depending annular portion 67 has a first inner annular portion 68 at its lower end and a second inner annular portion 69 connected to the first inner annular portion 68 by a connecting portion 70. The lower surface of the second annular portion 69 has one end of a diaphragm spring 71 acting thereagainst with the other end of the diaphragm spring 71 engaging the flat central portion of the washer 64. Thus, the diaphragm spring 71 holds the diaphragm 31 against atmospheric pressure when no partial vacuum is created within the chamber 34 so that the latch pin 45 is disposed in the position of FIG. 2 in which the balls 46 prevent downward movement of the latch plunger 47.

The second diaphragm 35 is retained between the upper end of the spacer 33 and the cap 37. The upper surface of the second diaphragm 35 is in communication with the inlet 11 upstream of the main poppet valve 17 so that the pressure of the liquid at the inlet 11 is transmitted to the upper surface of the second diaphragm 35. This communication is through a passage 72 in the nozzle body 10, an opening 73 in the diaphragm 31, a passage 74 in the spacer 33, an opening 75 in the second diaphragm 35, a connecting passage 76 in the cap 37, and a circular cavity or chamber 77 in the cap 37.

When there is a predetermined pressure existing in the nozzle body 10 between the inlet 11 and the outlet 14, the second diaphragm 35 is moved to the position of FIG. 1 by a spring 78, which has one end acting against the upper surface of the first annular portion 68 (see FIG. 3A) of the downwardly depending portion 67 of the spacer 33, having its other end acting on an annular surface 79 of a connector 80, which is hollow in the middle. The connector 80 has an upper annular surface 81 engaging the second diaphragm 35 and retains a circular washer 82 against the central portion of the second diaphragm 35 inside of the annular surface 81 by an annular shoulder 83 of the connector 80 engaging the outer portion of the washer 82.

When the spring 78 moves the second diaphragm 35 to the position of FIG. 1 in which the second diaphragm 35 abuts a surface 84 (see FIG. 3A) of the cap 37, an annular portion 85 of the connector 80 engages the bottom edges of a pair of upstanding fingers 86 of an annular upstanding portion of the connecting pin 65 to move the diaphragm 31 upwardly against the force of the diaphragm spring 71 to the position of FIG. 1. This lifts the latch pin 45 so that it no longer prevents the balls 46 from moving inwardly so as to allow the latch plunger 47 to be moved downwardly against the force of the spring 48 by the force of the valve spring 18. This results in the main poppet valve 17 being moved to its closed position by the spring 18 and the trigger 58 ceasing to engage one of the notches or steps of the rack 59 to hold the handle 56 in a valve open position.

Figure 2:
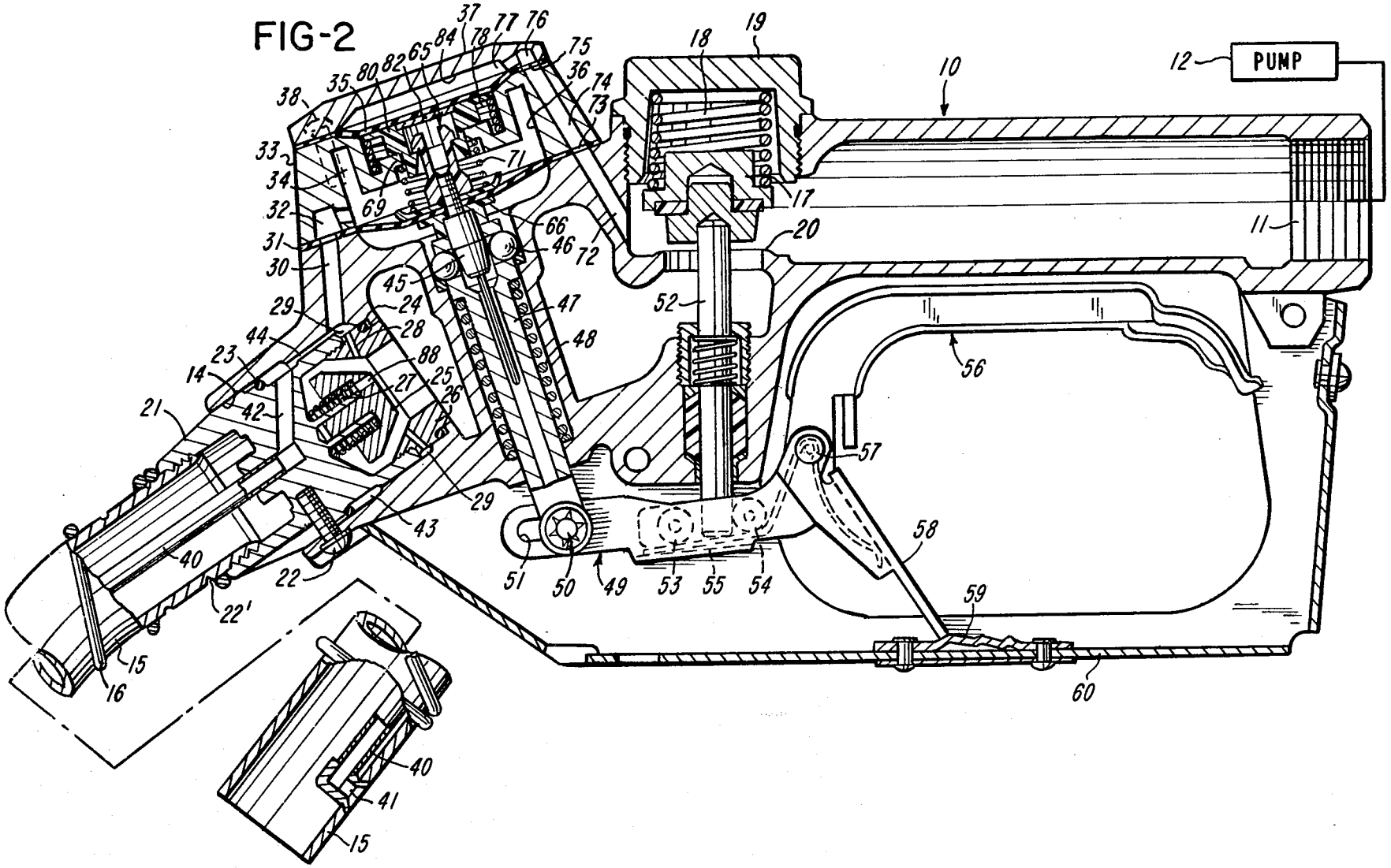
FIG. 2 is a sectional view, partly in elevation, of the nozzle of FIG. 1 with the pump activated, the main poppet valve open, and the handle holding mechanism activated.

When the pump 12 is activated so as to move the second diaphragm 35 away from the surface 84 of the cap 37 to form the chamber 77 therebetween as shown in FIGS. 2 and 3, the force acting on the second diaphragm 35 can vary significantly because the supply pressure is significantly reduced just prior to the pump 12 being inactivated. Accordingly, the movement of the second diaphragm 35 away from the surface 84 of the cap 37 is limited by an annular outer portion 87 of the connector 80 engaging the upper surface of the second annular portion 69 of the downwardly depending annular portion 67 of the spacer 33. This limiting of the movement of the second diaphragm 35 is necessary to insure that the first diaphragm 31 can be moved against the force of the diaphragm spring 71 when a partial vacuum is created in the chamber 34 by the opening 41 in the spout 15 being closed by the level of the liquid in the tank being filled.

This limiting of the movement of the second diaphragm 35 also enables the entire surface of the second diaphragm 35 to be supported by substantially rigid structure when subjected to a pressure due to the pump 12 being activated. The outer portion of the second diaphragm 35 is supported by the upper surface of the downwardly depending annular portion 67 of the spacer 33 with the connector 80 supporting the remaining portion of the second diaphragm 35 through the annular surface 81 (see FIG. 3A) and the circular washer 82. This is shown in FIGS. 2 and 3.

When the pump 12 is inactivated, the pressure in the nozzle body 10 between the inlet 11 and the poppet valve 25 decreases below two and one-half psi, which was the supply pressure when the liquid was being supplied at the low flow rate. Thus, when the pressure acting on the poppet valve 25 falls below two and one-half psi, the spring 27 moves the poppet valve 25 to its closed position. If the main poppet valve 17 is being retained in its open position by the trigger 58 holding the handle 56 in a valve open position through the trigger 58 engaging one of the steps or notches in the rack 59 as shown in FIG. 2, then the pressure between the inlet 11 and the poppet valve 25 would remain at about two and one-half psi upon closing of the poppet valve 25.

Since it is necessary for the second diaphragm 35 to be movable by the spring 78 only after the pump 12 is inactivated, the force of the spring 78 must not be strong enough to cause movement of the second diaphragm 35 against the surface 84 of the cap 37 prior to the poppet valve 25 closing; the poppet valve 25 cannot close until the pump 12 is inactivated. Therefore, the force of the spring 78 must not move the second diaphragm 35 against the surface 84 of the cap 37 until after the poppet valve 25 closes.

However, when the poppet valve 25 closes with the main poppet valve 17 open, there is pressure trapped between the poppet valve 25 and the inactivated pump 12. Because of the necessity of sizing the spring 78 so that it is operational at less pressure than the spring 27, the pressure between the poppet valve 25 and the inactivated pump 12 would be sufficiently high to hold the second diaphragm 35 away from the surface 84 of the cap 37 so that the first diaphragm 31 would not be moved upwardly by the connector 80 lifting the connecting pin 65 to cause release of the latch plunger 47 through upward movement of the latch pin 45.

Accordingly, a bleeder passage 88 extends through the venturi poppet valve 25 to enable pressure between the inactivated pump 12 and the closed poppet valve 25 to be dissipated to the atmosphere after the pump 12 has been shut down. As soon as a few drops of gasoline pass through the bleeder passage 88, the pressure between the closed poppet valve 25 and the inactivated pump 12 reduces to about two psi at which pressure the spring 78 can begin to move the second diaphragm 35 against the surface 84 of the cap 37 and the connector 80 upwardly. When upward movement of the second diaphragm 35 is completed through additional liquid flowing through the bleeder passage 88, the pressure between the closed poppet valve 25 and the inactivated pump 12 is reduced to substantially zero.

This upward movement of the connector 80 by the spring 78 causes the annular portion 85 of the connector 80 to engage the annular portion 86 of the connecting pins 65 to raise the first diaphragm 31 with the connecting pin 65 so that the latch pin 45 is moved upwardly to enable the balls 46 to move inwardly and release the latch plunger 47. As a result, the valve spring 18 moves the main poppet valve 17 to its closed position whereby the trigger 58 is withdrawn from engagement with the rack 59.

Thus, when the pump 12 is turned off, the main poppet valve 17 will be moved to its closed position. Therefore, there is no possibility of the main poppet valve 17 remaining open by the failure of the user to release the trigger 58 from engagement with the rack 59 since stopping of flow from the pump 12 automatically closes the main poppet valve 17 and removes the trigger 58 from engagement with the rack 59.

Considering the operation of the present invention, the user pays for a fixed sum of gasoline to a cashier, who enters the sum in a computer (not shown) to enable the pump 12 to be activated for the sum of gasoline for which payment has been made. Then, the user removes the nozzle body 10 from its support pedestal and inserts the spout 15 in the fill pipe of the vehicle tank to be filled. Next, the handle 56 is raised to move the main poppet valve 17 to an open position with the handle 56 being retained by the trigger 58 cooperating with the rack 59 to hold the handle 56 at the flow rate position to which it is moved. If the opening 41 in the spout 15 is blocked by the liquid in the tank being filled before the pump 12 is inactivated, a partial vacuum will be created in the chamber 34 so that the force of the diaphragm spring 71 is overcome by atmospheric pressure to move the diaphragm 31 upwardly irrespective of the positions of the second diaphragm 35 and the connector 80. This results in the latch plunger 47 being released by inward movement of the balls 46 so that the valve spring 18 can move the main poppet valve 17 to its closed position. When this occurs, the trigger 58 is released from the rack 59 as shown and described in the aforesaid Boudot et al patent.

When the amount of gasoline for which the customer has paid is not sufficient to cause blocking of the opening 41, the computer (not shown) controls the pumping system to reduce the supply pressure to about two and one-half psi and the flow rate to about one-half gallon per minute at the time that approximately one-fifth gallon or less of the amount of gasoline purchased remains to be delivered. Then, when the pump 12 shuts off, the pressure in the nozzle body 10 between the inlet 11 and the poppet valve 25 decreases below two and one-half psi so that the spring 27 moves the poppet valve 25 to its closed position.

With the main poppet valve 17 staying open when the pump 12 shuts off, the trapped pressure is relieved through the bleeder passage 88 in the poppet valve 25. This reduces the trapped pressure to enable the spring 78 to move the second diaphragm 35 against the surface 84 of the cap 37 and the connector 80 upwardly. This upward movement of the connector 80 by the spring 78 causes the annular portion 85 of the connector 80 to engage the upstanding fingers 86 of the connecting pin 65 to raise the diaphragm 31 with the connector pin 65 so that the latch pin 45 is lifted to enable the balls 46 to move inwardly and release the latch plunger 47. As a result, the valve spring 18 moves the main poppet valve 17 to its closed position whereby the trigger 58 is withdrawn from engagement with the rack 59.

While the trapped pressure between the closed poppet valve 25 and the inactivated pump 12 has been shown and described as being relieved by the bleeder passage 88 in the poppet valve 25, it should be understood that any other suitable means for relieving the pressure in this portion of the passage means in the nozzle body 10 could be employed if desired. It is only necessary that there be some means for venting the trapped pressure without allowing the trapped liquid to be conveyed to the atmosphere.

It should be understood that any other suitable means could be employed to enable the poppet valve 17 to be moved to its closed position in response to the movement of the diaphragm 31 and the movement of the second diaphragm 35. Similarly, any other suitable handle mechanism may be employed other than that shown for opening the main poppet valve 17 and enabling the main poppet valve 17 to be automatically closed in response to the release means being effective.

An advantage of this invention is that the main poppet valve is automatically closed after stopping of the pump supplying the liquid under pressure. Another advantage of this invention is that there is no dependence on the user to release the handle retaining means when flow is stopped as this occurs automatically. A further advantage of this invention is that it enables the user to perform other functions at a self-service station while stopping flow when the vehicle tank becomes filled or when the quantity of purchased gasoline has been delivered.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. An automatic shut-off dispensing nozzle comprising a body having an inlet, an outlet, and passage means connecting said inlet to said outlet, valve means in said passage means for controlling liquid flow from said inlet to said outlet, movable means to move said valve means to an open position, holding means to hold said valve means in an open position, a first chamber in said body, a first diaphragm forming a first wall of said first chamber, a second diaphragm, venturi means disposed in said passage means downstream of said valve means to create a venturi effect when liquid flows through said passage means from said inlet to said outlet due to activation of a pressurized source communicating with said inlet, said venturi means including a valve seat, first passage means in said valve seat forming part of said passage means between said inlet and said outlet, second passage means in said valve seat providing communication of said first passage means with the atmosphere and said first chamber, and a valve cooperating with said valve seat to block said first passage means in said valve seat, means to urge said valve of said venturi means into engagement with said valve seat of said venturi means when the pressure in said passage means reaches a predetermined pressure greater than zero, release means to release said holding means resulting in said valve means being moved to its closed position, said first diaphragm being connected to said release means to render said release means effective upon movement of said first diaphragm in response to a partial vacuum created in said first chamber when the level of the liquid in a tank being filled reaches a predetermined level to block communication of said second passage means in said valve seat of said venturi means with the atmosphere, causing means to cause movement of said second diaphragm to a release position only when the pressure in said passage means is less than the predetermined pressure at which said urging means of said venturi means urges said valve of said venturi means into engagement with said valve seat of said venturi means, responsive means responsive to movement of said second diaphragm to its release position to render said release means effective when said second diaphragm is moved to its release position by said causing means, said responsive means allowing said first diaphragm to be moved in response to the partial vacuum created in said first chamber to render said release means effective when said second diaphragm is not in its release position, and relief means to decrease the pressure to substantially zero in said passage means when said valve of said venturi means engages said valve seat of said venturi means upon inactivation of the pressurized source communicating with said inlet to allow said second diaphragm to be moved to its release position by said causing means, said relief means communicating said passage means upstream of said valve of said venturi means with the atmosphere when said valve of said venturi means engages said valve seat of said venturi means.

2. The nozzle according to claim 1 in which said body has a second chamber having a wall formed by said second diaphragm and communicating means to provide communication between said second chamber and said passage means upstream of said valve means.

3. The nozzle according to claim 2 in which said relief means comprises a bleed passage extending through said valve of said venturi means.

4. The nozzle according to claim 3 in which said responsive means includes first means connected to one of said first diaphragm and said release means and second means movable relative to said first means and engageable therewith to move said first means to render said release means effective when said second diaphragm is moved to its release position.

5. The nozzle according to claim 4 in which said causing means includes resilient means continuously urging said second means against said second diaphragm and said second diaphragm to its release position.

6. The nozzle according to claim 5 including means secured to said body to engage said second means to limit the movement of said second diaphragm against the force of said resilient means when said second chamber has pressure applied thereto from said passage means through said communicating means so that said first diaphragm can still be moved in response to the partial vacuum created in said first chamber to render said release means effective.

7. The nozzle according to claim 6 in which said second means includes means surrounding said first means and engaging said first means to cause movement of said first means to render said release means effective when said second diaphragm is moved to its release position.

8. The nozzle according to claim 7 in which said secured means includes means engaging an outer portion of said second diaphragm when said second diaphragm has pressure applied thereto from said passage means through said communicating means and said second means includes means engaging the remaining portion inside of the outer portion of said second diaphragm when said second diaphragm has pressure applied thereto from said passage means through said communicating means.

9. The nozzle according to claim 6 in which said secured means includes means engaging an outer portion of said second diaphragm when said second diaphragm has pressure applied thereto from said passage means through said communicating means and said second means includes means engaging the remaining portion inside of the outer portion of said second diaphragm when said second diaphragm has pressure applied thereto from said passage means through said communicating means.

10. The nozzle according to claim 6 in which said second diaphragm forms a second wall of said first chamber and said second diaphragm is moved by said resilient means in the same direction as said first diaphragm moves in response to the partial vacuum created in said first chamber to render said release means effective.

11. The nozzle according to claim 5 including means to limit the movement of said second diaphragm against the force of said resilient means when said second chamber has pressure applied thereto from said passage means through said communicating means so that said first diaphragm can still be moved by the partial vacuum created in said first chamber to render said release means effective.

12. The nozzle according to claim 11 in which said second diaphragm forms a second wall of said first chamber and said second diaphragm is moved by said resilient means in the same direction as said first diaphragm moves in response to the partial vacuum created in said first chamber to render said release means effective.

13. The nozzle according to claim 5 in which said second diaphragm forms a second wall of said first chamber and said second diaphragm is moved by said resilient means in the same direction as said first diaphragm moves in response to the partial vacuum created in said first chamber to render said release means effective.

14. The nozzle according to claim 5 in which said second means includes means surrounding said first means and engaging said first means to cause movement of said first means to render said release means effective when said second diaphragm is moved to its release position.

15. The nozzle according to claim 1 in which said responsive means includes first means connected to one of said first diaphragm and said release means and second means movable relative to said first means and engageable therewith to move said first means to render said release means effective when said second diaphragm is moved to its release position.

16. The nozzle according to claim 15 in which said causing means includes resilient means continuously urging said second means against said second diaphragm and said second diaphragm to its release position.

17. The nozzle according to claim 16 in which said second means includes means surrounding said first means and engaging said first means to cause movement of said first means to render said release means effective when said second diaphragm is moved to its release position.

* * * * *